US009487340B2

(12) United States Patent
Castela et al.

(10) Patent No.: US 9,487,340 B2
(45) Date of Patent: Nov. 8, 2016

(54) TISSUE BOX

(75) Inventors: Gonzalo Castela, Theux (BE); Jacky Deschamps, Jalhay (BE); Nicolas Toumpsin, Ensival (BE)

(73) Assignee: SCA HYGIENE PRODUCTS AB, Göteborg (SE)

( * ) Notice: Subject to any disclaimer, the term of this patent is extended or adjusted under 35 U.S.C. 154(b) by 160 days.

(21) Appl. No.: 12/599,227

(22) PCT Filed: May 8, 2007

(86) PCT No.: PCT/SE2007/050314

§ 371 (c)(1),
(2), (4) Date: Nov. 6, 2009

(87) PCT Pub. No.: WO2008/136721

PCT Pub. Date: Nov. 13, 2008

(65) Prior Publication Data

US 2010/0243668 A1 Sep. 30, 2010

(51) Int. Cl.
*B65D 83/08* (2006.01)
*A47K 10/32* (2006.01)

(52) U.S. Cl.
CPC ... *B65D 83/0805* (2013.01); *A47K 2010/3266* (2013.01)

(58) Field of Classification Search
USPC ..... 221/33, 45, 63, 135, 303, 307, 309
See application file for complete search history.

(56) References Cited

U.S. PATENT DOCUMENTS 3,401,928 A 9/1968 Frick
4,131,271 A 12/1978 Slawny
4,200,200 A * 4/1980 Hein et al. ..... 221/48
4,458,810 A * 7/1984 Mahoney ..... 206/210
6,550,639 B2 * 4/2003 Brown et al. ..... 221/135
7,654,412 B2 * 2/2010 Amundson et al. ..... 221/63
2002/0043537 A1 * 4/2002 Serbiak ..... 221/33
2004/0124101 A1 7/2004 Mitchell et al.
2004/0164085 A1 * 8/2004 Kitching et al. ..... 221/45
2006/0222845 A1 * 10/2006 Deng ..... A01N 25/34 428/336

FOREIGN PATENT DOCUMENTS

EP 0953516 11/1999
EP 1039027 2/2000

(Continued)

OTHER PUBLICATIONS

International Search Report dated Jan. 7, 2008, in PCT application.

*Primary Examiner* — Gene Crawford
*Assistant Examiner* — Kelvin L Randall, Jr.
(74) *Attorney, Agent, or Firm* — Drinker Biddle & Reath LLP

(57) ABSTRACT

A disposable container for tissues (a tissue box) includes a plurality of sides defining an interior space, wherein at least one side includes at least one dispensing opening. The dispensing opening is at least partially covered by a dispensing insert which includes at least one active substance and is arranged such that active substance is transferred to at least a portion of the tissues. The materials and structure of the container allow tissues to be impregnated with an active substance—such as a fragrance—as each tissue is dispensed from the container. The disposable container and a package including the disposable container and a plurality of tissues located within the container are described.

19 Claims, 2 Drawing Sheets

(56) References Cited

FOREIGN PATENT DOCUMENTS

| | | | | |
|---|---|---|---|---|
| EP | 1036880 | | | 3/2000 |
| JP | 11079263 | | | 3/1999 |
| JP | 2001029261 | | | 2/2001 |
| JP | 2004115055 | | | 4/2004 |
| JP | 2007008542 | | | 1/2007 |
| JP | 2007008542 | A | * | 1/2007 |
| WO | 2004057109 | | | 7/2004 |
| WO | 2005066043 | | | 7/2005 |
| WO | 2006104943 | | | 10/2006 |

* cited by examiner

TISSUE BOX

TECHNICAL FIELD

The present invention concerns a disposable container for tissues (a tissue box). The materials and structure of the container allow tissues to be impregnated with an active substance such as a fragrance. The invention relates both to the disposable container and to a package comprising the disposable container and a plurality of tissues located within said container.

BACKGROUND OF THE INVENTION

Tissue boxes allow of a number of tissues to be efficiently packaged together, and permit individual tissues to be dispensed. In their most basic form, tissue boxes comprise a number of walls defining an interior space which encloses the tissues and an opening in a wall through which tissues are dispensed. It is common for tissue boxes to incorporate a dispensing film or insert in the dispensing opening, which limits the extent of the tissue box that is open to contamination, and which comprises an opening or slit which allows tissues to be dispensed. In recent years, a variety of designs and technical functions have been incorporated into such boxes and their associated tissues.

Efforts have been made to provide tissue boxes which also dispense fragrance. For example, US 2004/0124101 describes a disposable dispenser having patches attached to one or more walls thereof, the patches containing odour control agents. WO 2006/104943 discloses a disposable container having apertures which allow fragrance inside the container to exit to the external environment. U.S. Pat. No. 4,458,810 discloses tissues which are disposed between scent-carrying layers in a tissue box, which impregnate the disposable tissues with their scent.

EP 0953 516 discloses a tissue box in which the dispensing insert is made of a material with high resilience.

WO 2005/066043 discloses a tissue box in which the dispensing film can comprise a glow-in-the-dark material which allows the tissue box to be located and used in the dark.

In the current process for providing tissues with an active substance such as a fragrance, stacks or rolls of tissues are sprayed with the fragrance before being incorporated into a container. This leads to waste of fragrance, and difficulties in determining the amount of fragrance which is actually taken up by the tissues. In addition, spraying bulk chemicals in this manner often presents health and environmental hazards (e.g. allergies in the workers associated with the spraying process).

There remains a need for a disposable container for tissues which, with minimal alteration from known tissue containers, can be used to effectively and efficiently dispense tissues upon which an active substance (such as a fragrance) is present. It is desirable to avoid the problems associated with applying active substances in bulk to tissues before they are placed into a container.

SUMMARY OF THE INVENTION

The invention relates to a disposable container for tissues. The container comprises a plurality of sides which define an interior space. At least one side comprises at least one dispensing opening, said dispensing opening being at least partially covered by a dispensing insert. The dispensing insert comprises at least one active substance and is arranged such that active substance is transferred to at least a portion of said tissue. Suitably, transfer of active substance takes place upon dispensing a tissue from said container.

The container thus provides an effective way to apply an active substance to tissues, avoiding the complications related to the previously-known techniques. As active substance is only present in the dispensing insert, manufacture is simplified, as this component can be manufactured separately and incorporated into standard containers. Chemical hazards related to the impregnation and handling of large numbers of tissues are also reduced.

Suitably, the disposable container according to the invention comprises one dispensing opening. The dispensing insert may extend across the entire dispensing opening and comprise an opening for dispensing tissues.

Preferably, the active substance is located at least on the inner face of the dispensing insert.

The container may comprise a dispensing cover which covers the dispensing opening before the container is put into use.

The active substance may be a fragrance or an insecticide. In a certain embodiment, over 50%, such as over 70%, over 80%, over 95% or 100% of the active substance is located within 3 cm, preferably within 2 cm, preferably within 1 cm of the opening in the dispensing insert.

The invention also relates to a package comprising a disposable container of the invention and a plurality of tissues located within said disposable container.

Suitably, the tissues are dry when introduced into the container. The tissues in the container may be stacked and/or interleaved.

DEFINITIONS

The term "disposable" is used herein to refer to articles which are intended for single or limited use only, and are not intended to be re-used. The containers of the invention are disposable, in that they are designed to be discarded when empty rather than being refilled, in contrast to refillable tissue dispensers. The tissues of the invention are also disposable, in that they are not designed to be washed or cleaned and re-used after a limited number of uses.

BRIEF DESCRIPTION OF THE DRAWINGS

The invention will now be described more closely with reference to the enclosed Figures, in which.

DETAILED DESCRIPTION OF PREFERRED EMBODIMENTS

Figure 1:
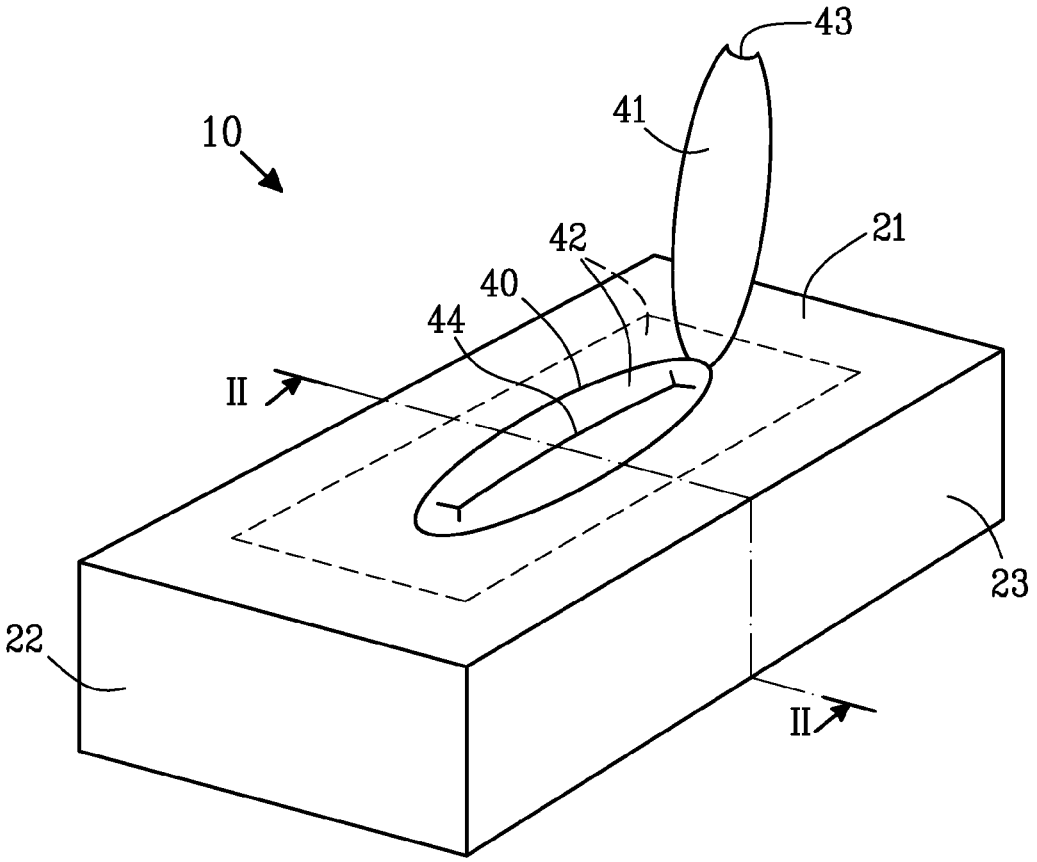
FIG. 1 shows an embodiment of the disposable container according to the invention.

FIG. 1 shows a disposable container 10 according to the invention. The container 10 comprises a plurality of sides 21, 22, 23 . . . which define an interior space 30. The interior space is intended to contain tissues 60. The illustrated container 10 is cuboid (with 6 adjoining rectangular sides), although other geometries for tissue boxes are also to be considered within the scope of the present invention (e.g. other polyhedra such as pyramidal). The disposable container 10 is most suitably made of a cheap lightweight disposable material such as cardboard or plastic, preferably cardboard. The container 10 is manufactured using standard construction methods for such items, such as folding, gluing and cutting blanks of the appropriate materials.

Figure 2:
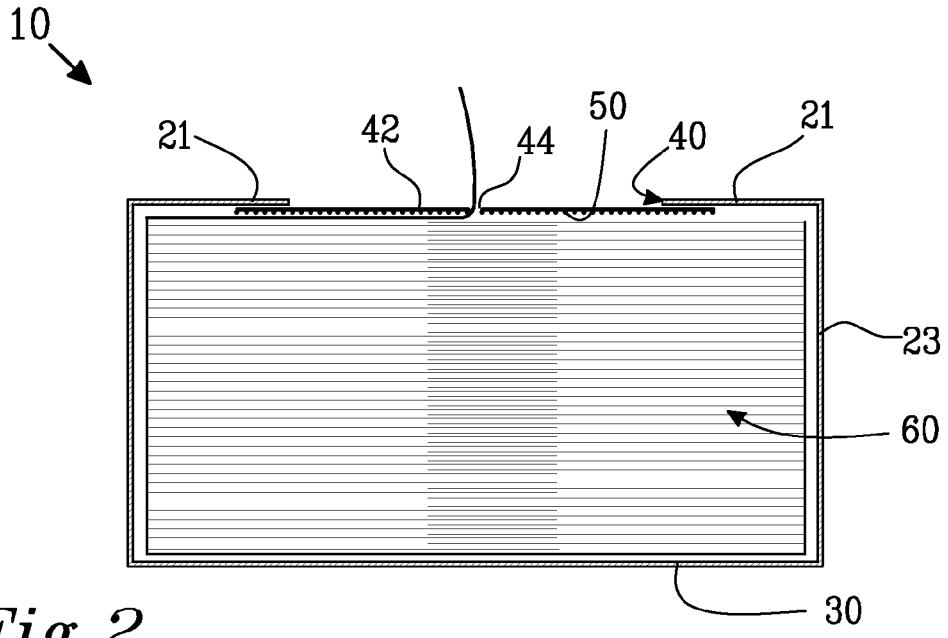
FIG. 2 is a cross-sectional view of the container according to FIG. 1 along the line II-II.
Figure 3:
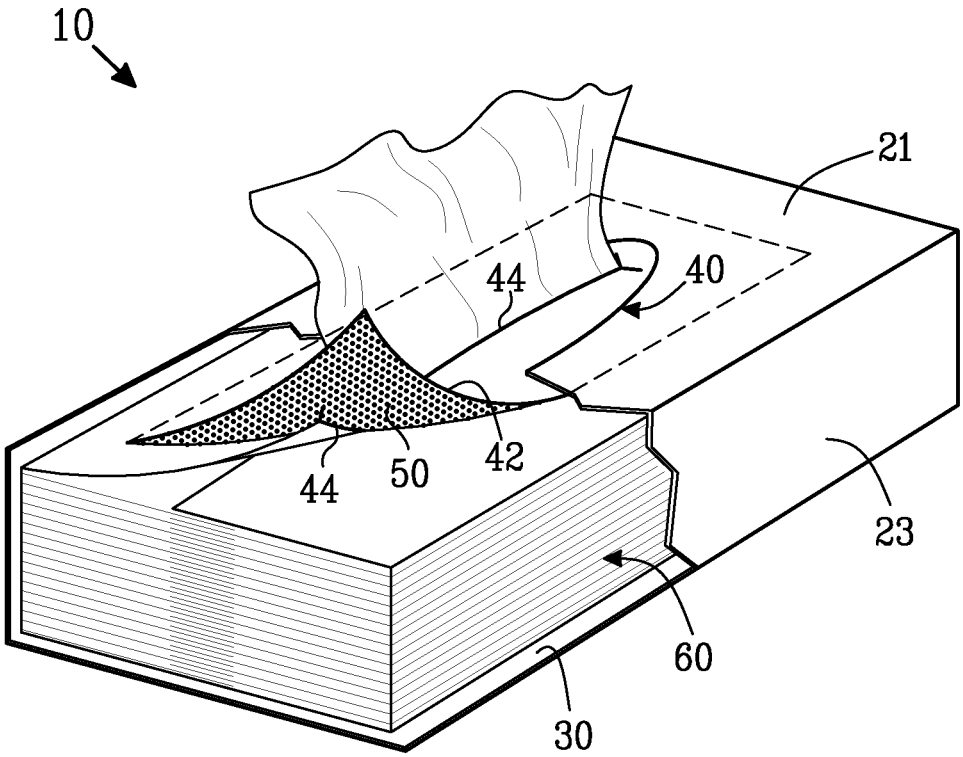
FIG. 3 is a cut-away view of the container according to FIG. 1 along the line II-II.

The disposable container 10 is designed to contain a plurality of tissues 60 and dispense them in a controlled fashion (e.g. one at a time). The disposable container 10 usually contains between 60 and 200 tissues, preferably between 80 and 120 tissues. However, in certain situations, the container may contain as few as 5 or 10 tissues (e.g. a hankies pack). The tissues 60 may be e.g. hankies, facial tissue, bathroom tissue, paper napkins, or paper towels, and may be present in a stack or a roll. If stacked, as shown in FIGS. 2 and 3, the tissues may be folded and/or interleaved, such that dispensing of one tissue causes the following tissue to be presented through the dispensing opening 40. Interleaving is described in U.S. Pat. No. 3,401,928 and U.S. Pat. No. 4,131,271. A roll of tissues 60 may be centre-feed or edge-feed. The tissues 60 may be single discrete tissues, or adjacent tissues may be adjoined and separable via e.g. perforations. It is advantageous that the container 10 is not completely filled with tissues 60 so that a gap is maintained between the tissues 60 and the container 10. This provides an air space into which active substance 50 can diffuse, thereby more effectively impregnating the tissues 60.

Tissues 60 may comprise natural fibres such as wood pulp, pulp fluff or natural cellulose. Alternatively or additionally, the tissues 60 may comprise synthetic fibres such as synthetic cellulose or polymeric fibres or filaments. The fibres may be short fibres (staple fibres) or continuous fibres (filaments). The tissues 60 may also comprise substances which are commonly used in paper- or tissue-making technology, e.g. wet-strength agents, softening agents, binders, dewatering aids, sizing agents, colorants or bleaches.

Tissues 60 may be made according to any standard method for manufacturing tissues known in the art. Generally, the components of the tissue are first wet-laid on a moving web. The tissue is then dewatered, creped to form the characteristic soft tissue structure and finally dried. The tissue may be one-ply or multiple-ply. Each ply may have more than one, typically two or three layers. Steps of embossing, laminating, pressing, printing or perforating may be included as desired. The final tissue web may be rolled, folded or cut to provide tissues in the required form. Methods for manufacturing tissues are described in e.g. WO 04/057109, EP 1036880 and EP 1039027.

The tissues 60 according to the invention are suitably "dry" when introduced into the container 10. In other words, they are not treated with any active substance 50 after the final drying, folding and/or rolling steps of their manufacture. This is in contrast to so-called wet-wipes, in which tissues may be impregnated with active substance 50 before being introduced into the container 10. However, the invention may also be used with wet wipes which comprise e.g. lotion, but are also impregnated with an active substance 50 (e.g. a fragrance) by the container 10 of the invention.

At least one side 21 of the container 10 comprises at least one dispensing opening 40, through which tissues are dispensed. It is possible that a dispensing opening 40 is present on more than one side 21, 22 of the container 10, or that more than one dispensing opening 40 is present on one side 21. In such cases, each dispensing opening 40 may provide different active substances 50 to be transferred to the tissue upon dispensing. It is also possible that a single dispensing opening 40 extends over two or more sides of the container 10. However, it is preferred that one dispensing opening 40 is present on one side 21 of the container 10, as illustrated in FIG. 1.

The dispensing opening 40 shown in FIG. 1 has an oval shape, with its longest axis aligned with the longest axis of the container 10. The dispensing opening 40 may however have other shapes, e.g. square, circular or rectangular. The dispensing opening 40 may even extend over one entire side of the container 10.

The container 10 may comprise a dispensing cover 41, which covers the dispensing opening 40 before the container is put into use, thus protecting the contents. The dispensing cover 41 may comprise a separate piece of material to the container 10, such as a plastic film which has a greater extension than the dispensing opening 40 and overlaps the dispensing opening 40 in all directions. In this case, the dispensing cover may be attached to the container 10 by means of adhesive, mechanical fastening or other suitable attachment means. Alternatively, the dispensing cover 41 may comprise the same material as the container 10, and be defined by the boundary of the dispensing opening 40. Indications such as embossments or printed matter may be used to indicate the location of the dispensing cover 41.

When the container 10 is to be used, the dispensing cover 41 is removed. Suitably, the dispensing cover 41 can be removed from the container 10 by manual force, so that tools such as scissors are not required to access the contents of the container 10. This can be achieved for instance by incorporating tear lines, perforations, intermittent or weakened adhesive or similar weak points in the joint between the dispensing cover 41 and the dispensing opening 40. FIG. 1 shows a dispensing cover 41 which is defined by perforations in the container 10. The dispensing cover 41 may be completely removed from the container 10, or may remain joined to the container 10, provided that access to the tissues 60 is not hindered. The dispensing cover 41 may comprise gripping means 43 which allow it to be readily grasped and removed from the container 10 by the fingers of a user. For example, the gripping means 43 may comprise an extra piece of material on the dispensing cover 41 which is not joined to the container 10 and thus projects from the container 10. Alternatively, the gripping means 43 may comprise a cut-out or a region defined by perforations through which the user's finger can be readily inserted (FIG. 1).

The dispensing opening 40 is at least partially covered by a dispensing insert 42. The dispensing insert 42 limits the extent of the container which is open to contamination, yet allows tissues 60 to be dispensed. The dispensing insert 42 is designed to remain in place on the container 10 until all tissues have been dispensed.

FIG. 1 illustrates a dispensing insert 42 which extends across the entire dispensing opening 40 and which itself comprises an opening 44 (a slit is illustrated in FIG. 1). The dispensing insert 42 comprises a flexible, resilient material, which allows the user to access the tissues 60 with their fingers and to pull them through the opening 44. dispensing insert 42 is shown as rectangular in FIG. 1. The opening 44 may take a variety of shapes, e.g. a single line, a cross-shape, a star-shape or a line with Y-shapes at either end as illustrated in FIG. 1. The dispensing insert 42 can also act to grip the leading edge of the following tissue, and prevent it from falling back into the box, so that dispensing of the following tissue is simplified.

The dispensing insert 42 may comprise an opening 44 which has a form other than a slit, e.g. square, circular, triangular etc., through which tissues 60 can be dispensed. In addition, the dispensing insert 42 may not extend across the entire dispensing opening 40, so that tissues 60 can be dispensed from the container 10 in the gap thus formed between the edge of the dispensing opening 40 and the dispensing insert 42.

Typically, the dispensing insert 42 has an extension which is greater than the dispensing opening 40 and is joined to the inside of the container 10, in the region surrounding dispensing opening 40. This is illustrated more closely in FIG. 2. Joining of the dispensing insert 42 to the inside of the container 10 is carried out by any means known in the art, preferably by gluing.

Suitably, the dispensing insert 42 is a plastic film or a laminate of two or more plastic films. Polymers from which the plastic films may be manufactured are thermoplastic polymers, such as polyethylene, polyesters, polypropylene and mixtures thereof. Polyethylene is a preferred polymer.

Other materials which might be suitable for the dispensing insert 42 include foam, rubber, paper and nonwoven materials.

The dispensing insert 42 comprises at least one active substance 50. An active substance 50 is a substance which provides particular effects when applied to a tissue, over and above the effects provided by the tissue alone. The active substance 50 is preferably volatile. The term "active substance" does not include any substances which are included in the manufacturing of the tissues, e.g. wet-strength agents, softening agents, binders, bleaches, etc. The effects of the active substance 50 may be noticeable when the tissue is used, e.g. when placed in contact with the skin of a user; alternatively, the effects of the active substance 50 may be noticeable before use (e.g. upon dispensing a tissue 60 from the container 10). For simplicity, the dispensing insert 42 preferably comprises one active substance 50, but may comprise a combination of more than one active substance 50, such as 2, 3, 4, 5 or more active substances 50.

Suitably, the active substance 50 is present in an amount of between 6 and 40 weight %, preferably between 10 and 30 weight %.

Active substances 50 of particular interest are fragrances. The term "fragrance" includes perfumes, scents, odours and other volatile substances which can be distinguished by their smell. Essential oils (volatile oils which occur in plant and provide the plant with its characteristic odour, flavour, or other such property) are useful fragrances. Examples of fragrances include but are not limited to: ajowan, almond, allspice, aloe vera, ammi visnaga (khella), amyris, angelica root, angelica seed, anise, apricot, absolute arnica, avocado, balsam, basil, bay laurel, bay leaf, bees wax, benzoin absolute, bergamot, birch, borage, boronia, buchu leaf, cajeput, calamus, calendula, camellia, cannabis, caraway, cardamom, absolute carnation, carrot seed, cassia, cassis bud (black currant), castor, catnip, cedarleaf, cedarwood, celery seed, chamomile, champaca, cilantro, cinnamon, cistus, citronella, ciste, artificial civet, clary sage, clementine, clove, cocoa, cocoa butter, coconut, cognac, combava, coriander, cornmint, costus, cumin, cypress, davana, dill, dill weed, elemi, erigeron (fleabane), eucalyptus, fennel, fenugreek, fir, frankincense, galbanum, garlic, genes, geranium, ginger, ginseng, grapefruit, grapeseed, hazelnut, helichrysum, hemp, absolute honeysuckle, hyssop, absolute immortelle, fragrant aster inula, Jamaican gold, jasmine, jojoba, absolute jonquille, juniper berry, lanolin, lantana camera, laurel nobilis, lavender, lavendin, lemon, lemongrass, lime, litsea, lotus, macadamia, mace, mandarin, manuka, marigold, marjoram, massoia bark, melissa, mimosa, monarda, mugwort, musk seed, myrrh, myrtle, absolute narcissus, neroli (orange blossom), niaouli, nutmeg, oakmoss, olibanum, absolute opopanax, orange, wild West Indian orange, oregano, orris root, osmanthus, palm, palmarosa, paprika, patchouli, peanut, pecan, pennyroyal, pepper, peppermint, pet perfume, orange leaves, pine, evening primrose, ravensare, redberry, rosalina, rose, rosehip seed, rosemary, rosewood, rue, sage, sandalwood, seabuckthorn berry, sesame oil, shea butter, spikenard, spruce, St. John's wort, styrax resin, tagetes, tangerine, tarragon, tea tree, thuja (cedar leaf), thyme, mixed tocopherols, tofu balsam resin, tuberose, tumeric, valerian, vanilla, vegetable glycerin, verbena, vetiver, vitex, violet leaf, walnut oil, wintergreen, wormwood, yarrow, ylang ylang and combinations thereof.

The active substance 50 may also be another volatile material, such as an insect repellent (e.g. DEET or citronella), bactericide, virocide, anti-fungus, anti-flu, essential oils (e.g. anti-stress, expectorants).

The dispensing insert 42 is arranged such that active substance 50 is transferred to at least a portion of said tissues 60. Active substance 50 may be transferred to the tissues 60 in a number of ways. Firstly, active substance 50 may be transferred upon dispensing a tissue 60 from said container 10, i.e. through contact between the tissue and the dispensing insert 42 which causes active substance to be "rubbed off" the insert 42 and onto the tissues 60. To ensure effective transfer of the active substance 50 to the tissues 60, it is preferable that the active substance 50 is located on the inner face 45 of the dispensing insert 42 (i.e. that face which is directed towards the inside of the container 10, see FIG. 3). If the dispensing insert 42 is a laminate, the active substance 50 can be incorporated into the innermost layer of the laminate. Friction forces which are generated between the tissue 60 and the dispensing insert 42 upon dispensing a tissue 60 cause active substance 50 to be transferred from the dispensing insert 42 to the tissues 60.

Secondly, evaporation of the active substance 50 (which is volatile) creates a saturated atmosphere within the box, which impregnates the tissues 60. This effect is seen upon storage of the tissues, even before dispensing.

The active substance 50 may be coated onto the dispensing insert 42 (e.g. on its inner face 45) using any method known in the art for coating (e.g. spin-coating, solution coating, dipping, rolling, spraying etc.). Coating of the active substance 50 onto the dispensing insert 42 may be continuous or discontinuous. The active substance may also be impregnated into the material of the dispensing insert 42, e.g. if the dispensing insert 42 comprises a plastic film, active substances 50 can be included in a polymerisation reaction or forming process used in the manufacture of said film. This is typically carried out by mixing the active substance 50 (suitably in liquid form) with polymer particles, followed by extrusion of the mixture.

Desirably, the active substance 50 is encapsulated in so-called microcapsules, which are then deposited onto the dispensing insert 42. US2004/0124101 describes the use of microcapsules for releasing odor control agents. Friction between a tissue 60 and the dispensing insert 42 causes the microcapsules to rupture, thus releasing active substance 50 which is then transferred from the dispensing insert 42 to the tissues 60. Microcapsules of active substance 50 can be coated onto the dispensing insert 42, e.g. on the inner face 45, or may be incorporated into the material of the dispensing insert 42 during its manufacture.

To maximise physical transfer of active substance 50 from the dispensing insert 42 to the tissues 60, the active substance 50 may be concentrated in the region of the dispensing insert 42 located adjacent to the opening 44, as it is this region which makes most contact with the tissues 60 as they are dispensed. The region of the dispensing insert 42 located adjacent to the opening 44 is defined as that region of the dispensing insert 42 which is located within 3 cm, preferably within 2 cm, preferably within 1 cm of the opening 44, suitably in the longitudinal direction of the opening 44. In this way, the amount of active substance 50 in other areas of the dispensing insert 42 can be reduced, thus saving active substance 50. Concentrating the active substance in this area means that over 50%, such as over 70%, over 80%, over 95% or even 100% of the active substance 50 may be located in this region.

The present invention also relates to a package comprising the disposable container 10 described herein and a plurality of tissues 60 located within said disposable container 10. As described above, the tissues 60 are preferably dry when introduced into the container 10, and receive active substance 50 when dispensed from the container 10. The tissues 60 may be stacked and/or interleaved within the container 10.

Box Manufacture

A series of scented films were applied in boxes for facial tissues. The basic polymer used was low density polyethylene (LDPE). Pellets of the polymer were charged in perfume and extruded by blowing. Lamellate extrusion was also used if a thicker film was desired.

The perfumes in Table 1 were obtained from AB7 Industries, Deyme, France. The maximum amount of perfume possible was incorporated into the polymer matrix of LDPE, and the weight percentage of each perfume is shown in Table 1.

TABLE 1

Weight percent of perfume which can be incorporated into an LDPE film.

| No. | Perfume | % w/w |
|---|---|---|
| 1 | VIOLET | 15 |
| 2 | RICES | 15 |
| 3 | FLEUR OF LOTUS | 15 |
| 4 | LAVANDE-ORANGE | 22.5 |
| 5 | NIVEOLE PLUS ISO | 16.12 |
| 6 | NIVEOLE PLUS COEUR | 18.75 |
| 7 | APRICOT | 18.75 |
| 8 | LILY OF THE VALLEY | 15 |

Dosing Tests

Blind tests were carried out using 25 persons (17 men and 8 women). Tissue boxes with were manufactured with perfumed films, each film containing the maximum amount of perfume obtainable for each perfume. Tissues were dispensed from these boxes, and assessed for perfume dosage.

TABLE 2

Dosing tests - number of persons making each conclusion.

| Perfume | No perfume or impossible to smell it | Little perfume | Good quantity of perfume | Much perfume | Too much perfume |
|---|---|---|---|---|---|
| LAVANDE-ORANGE | 0 | 1 | 15 | 4 | 5 |
| VIOLET | 0 | 5 | 14 | 6 | 0 |
| RICE | 0 | 1 | 17 | 4 | 3 |
| LOTUS FLOWER | 0 | 5 | 16 | 4 | 0 |
| NIVEOLE | 2 | 3 | 8 | 9 | 3 |
| LILY OF THE VALLEY | 0 | 2 | 17 | 3 | 3 |

As can be seen, the tissue boxes of the present invention provide perfumed tissues which are predominantly judged to contain a good quantity of perfume.

The invention has been described with reference to a number of figures, embodiments and examples. However, the invention should not be considered as limited by these particular embodiments—features from various embodiments can be combined as the skilled person will understand, within the scope of the invention. The full scope of the invention should be considered as being defined by the appended claims.

The invention claimed is:

1. A disposable container for tissues, said container comprising:

a plurality of sides defining an interior space, at least one side comprising at least one dispensing opening being at least partially covered by a dispensing insert, said dispensing insert being a plastic film or laminate of two or more plastic films, wherein the dispensing insert has an opening and is impregnated with at least one active substance and is arranged such that active substance is transferred to at least a portion of said tissues, over 50% of the active substance is located within 3 cm of the opening in the dispensing insert, and the active substance is between 6% and 40% by weight of the total weight of the dispensing insert.

2. The disposable container according to claim 1, wherein the dispensing insert is arranged such that active substance is transferred to at least a portion of said tissues upon dispensing a tissue from said container.

3. The disposable container according to claim 1, wherein said container comprises a single dispensing opening.

4. The disposable container according to claim 1, wherein the dispensing insert extends across the entire dispensing opening and comprises an opening for dispensing tissues.

5. The disposable container according to claim 1, wherein the active substance is located at least on the inner face of the dispensing insert.

6. The disposable container according to claim 1, wherein said container comprises a dispensing cover which covers the dispensing opening before the container is put into use.

7. The disposable container according to claim 1, wherein the active substance is a fragrance.

8. The disposable container according to claim 1, wherein the active substance is an insecticide.

9. The disposable container according to claim 1, wherein over 70% of the active substance is located within 2 cm of the opening in the dispensing insert.

10. The disposable container according to claim 1, wherein over 80% of the active substance is located within 1 cm of the opening in the dispensing insert.

11. The disposable container according to claim 1, wherein over 95% of the active substance is located within 1 cm of the opening in the dispensing insert.

12. A package comprising a disposable container according to claim 1 and a plurality of tissues located within said disposable container.

13. The package according to claim 12, wherein the tissues are dry when introduced into the container.

14. The package according to claim 12, wherein the tissues are stacked in the container.

15. The package according to claim 12, wherein the tissues are interleaved in the container.

16. The disposable container according to claim 1, wherein the active substance comprises between 10% and 30% by weight of the dispensing insert.

17. The disposable container according to claim 1, wherein the active substance is encapsulated in microcapsules.

18. The disposable container according to claim 1, wherein the active substance is an insect repellent, a bactericide, a virocide, and anti-fugus, and anti-flu or an essential oil.

19. A disposable container for tissues, said container comprising:

a plurality of sides defining an interior space, at least one side comprising at least one dispensing opening being at least partially covered by a dispensing insert, said dispensing insert being a plastic film or laminate of two or more plastic films, wherein the dispensing insert has an opening and is impregnated with at least one active substance and is arranged such that active substance is transferred to at least a portion of said tissues, over 70% of the active substance is located within 2 cm of the opening in the dispensing insert, and the active substance comprises between 10% and 30% by weight of the total weight of the dispensing insert.

* * * * *